US007726903B2

(12) United States Patent
Vrondran et al.

(10) Patent No.: US 7,726,903 B2
(45) Date of Patent: Jun. 1, 2010

(54) MANHOLE SYSTEM

(75) Inventors: Kevin S. Vrondran, East Jordan, MI (US); Jeremy I. Johnson, East Jordan, MI (US); David Fuller, Ellsworth, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 181 days.

(21) Appl. No.: 11/972,153

(22) Filed: Jan. 10, 2008

(65) Prior Publication Data

US 2009/0180832 A1 Jul. 16, 2009

(51) Int. Cl.
*E06B 11/00* (2006.01)

(52) U.S. Cl. ..... 404/25; 52/19

(58) Field of Classification Search ..... 404/25, 404/26; 52/19, 20

See application file for complete search history.

(56) References Cited

U.S. PATENT DOCUMENTS 1,158,875 A * 11/1915 Warman ..... 432/158
1,226,766 A * 5/1917 Gammeter ..... 220/315
3,425,313 A * 2/1969 Villo ..... 411/373
3,858,998 A * 1/1975 Larsson et al. ..... 404/26
4,145,151 A * 3/1979 Helms ..... 404/25
4,279,356 A * 7/1981 Amorese et al. ..... 220/314
4,607,760 A * 8/1986 Roche ..... 220/314
5,394,650 A * 3/1995 Dean ..... 49/386
6,371,687 B1 * 4/2002 Heintz et al. ..... 404/26
7,537,413 B1 * 5/2009 Brugos ..... 404/25

* cited by examiner

*Primary Examiner*—Raymond W Addie
(74) *Attorney, Agent, or Firm*—Warner Norcross & Judd LLP

(57) ABSTRACT

A manhole system that includes a manhole cover and a frame with at least one locking device for maintaining the manhole cover in place on the frame. The locking device is selectively movable between locked and unlocked positions to selectively engage the cover to hold the cover in place on the frame. The locking device may be rotatable between "locked" and "unlocked" positions about an axis perpendicular to the plane of the cover. The locking device may includes a plurality of cam locks that engage the outer circumferential edge of the cover and are configured to increasingly clamp down the cover against the frame with increasing rotation from "unlocked" position to "locked" position. A plurality of locks can be arranged around frame to engage the cover at different locations.

4 Claims, 9 Drawing Sheets

MANHOLE SYSTEM

BACKGROUND OF THE INVENTION

The present invention relates to manhole closure assemblies and, more particularly, to manhole closure assemblies that can be maintained in a closed position.

Manholes are both well-known and widely utilized. Manholes are generally utilized as means for accessing an infrastructure, such as underground pipelines or cabling. Because manholes are essentially open holes into which an individual can fall, manhole covers are utilized to prevent entry into the manhole. A traditional manhole cover rests on a frame that is attached to the substructure above the infrastructure to be maintained. The cover rests on the frame and must be lifted and moved in order to gain access to the infrastructure beneath the manhole. Typically, manhole covers are formed of iron or other heavy metals and thus can weigh in excess of 100 pounds, creating a cover that is cumbersome to lift and otherwise maneuver. Although it can make manipulation of the cover difficult, the weight of the manhole cover is a benefit in that it helps to prevent the cover from being inadvertently removed from the frame, for example, by the force of passing vehicle traffic. It also helps to deter removal of the cover by unauthorized individuals.

It is known to lock a manhole cover to a surrounding frame. In many applications, the lock is, as far as is possible, tamper-proof. The frequency with which the lock is used, i.e. locked and unlocked, may be high or low, depending on the circumstances. In many instances though a manhole cover will remain locked for a considerable period. The environmental conditions to which a manhole cover is exposed may also be severe and the cover may be subjected to a wide temperature range, the full effects of the weather e.g. rain and snow, traffic and the like. In an effort to effectuate a locking mechanism various padlock configurations, keyed locks or other similar locking devices have been utilized. The use of such locks has not gained popularity because they are cumbersome and difficult to utilize. They may also fail over long periods of exposure to environmental conditions.

SUMMARY OF THE INVENTION

The present invention provides a manhole system that includes a manhole cover and a frame with at least one locking device for maintaining the manhole cover in place on the frame. The locking device is selectively movable between locked and unlocked positions to selectively engage the cover to hold the cover in place on the frame. In one embodiment, the lock device is rotatable between "locked" and "unlocked" positions about an axis perpendicular to the plane of the cover.

In an embodiment of the present invention the locking device includes a plurality of cam locks that include an angled or cammed surface. In one embodiment, the locks operatively engage the outer circumferential edge of the cover and are configured are cammed to increasingly clamp down the cover with increasing rotation from "unlocked" position to "locked" position. A plurality of locks can be arranged around frame to engage the cover at different locations. The locks can be positioned radially symmetric about frame.

In one embodiment, the cover is generally circular in shape and includes a circumferential edge that interacts with the locks \to maintain the cover in place within the frame. The cover can include a continuous flange that extends around the entire periphery of the cover so that the cover can be installed in essentially any orientation. Alternatively, the cover can include separate locking flanges that are arranged at desired positions around the cover to ensure that the cover is installed in a specific orientation. Additionally, the locks can be recessed and the cover can include a recessed annular flange to receive locks.

In one embodiment, each lock is mounted to the frame within a seat. The lock may be removably secured within the seat by a plunger and spring. The plunger and spring may be configured to provide a bias or tactile response when the lock is positioned in either the "locked" or "unlocked" positions.

In an embodiment, the locks have a truncated circular shape. In use, the lock is rotated so that the truncated portion is fully aligned with the cover when the lock is in the "unlocked" position, thereby permitting the cover to be removed from the frame. When not in the "unlocked" position, the truncated portion is not fully aligned with the cove and therefore at least a portion of the lock remains engaged with the cover. This prevents the cover from being removed from the frame when the lock is not in the "unlocked" position.

In one embodiment, the system is a watertight manhole system. In this embodiment, a gasket can be disposed between the cover and the frame for creating a watertight seal. The gasket is compressed between the cover and the frame when the locking devices are engaged within the system. The locks are configured to provide the appropriate amount of gasket compression when in the "locked" position.

These and other objects, advantages, and features of the invention will be readily understood and appreciated by reference to the detailed description of the current embodiment and the drawings.

DESCRIPTION OF THE CURRENT EMBODIMENT

Figure 1:
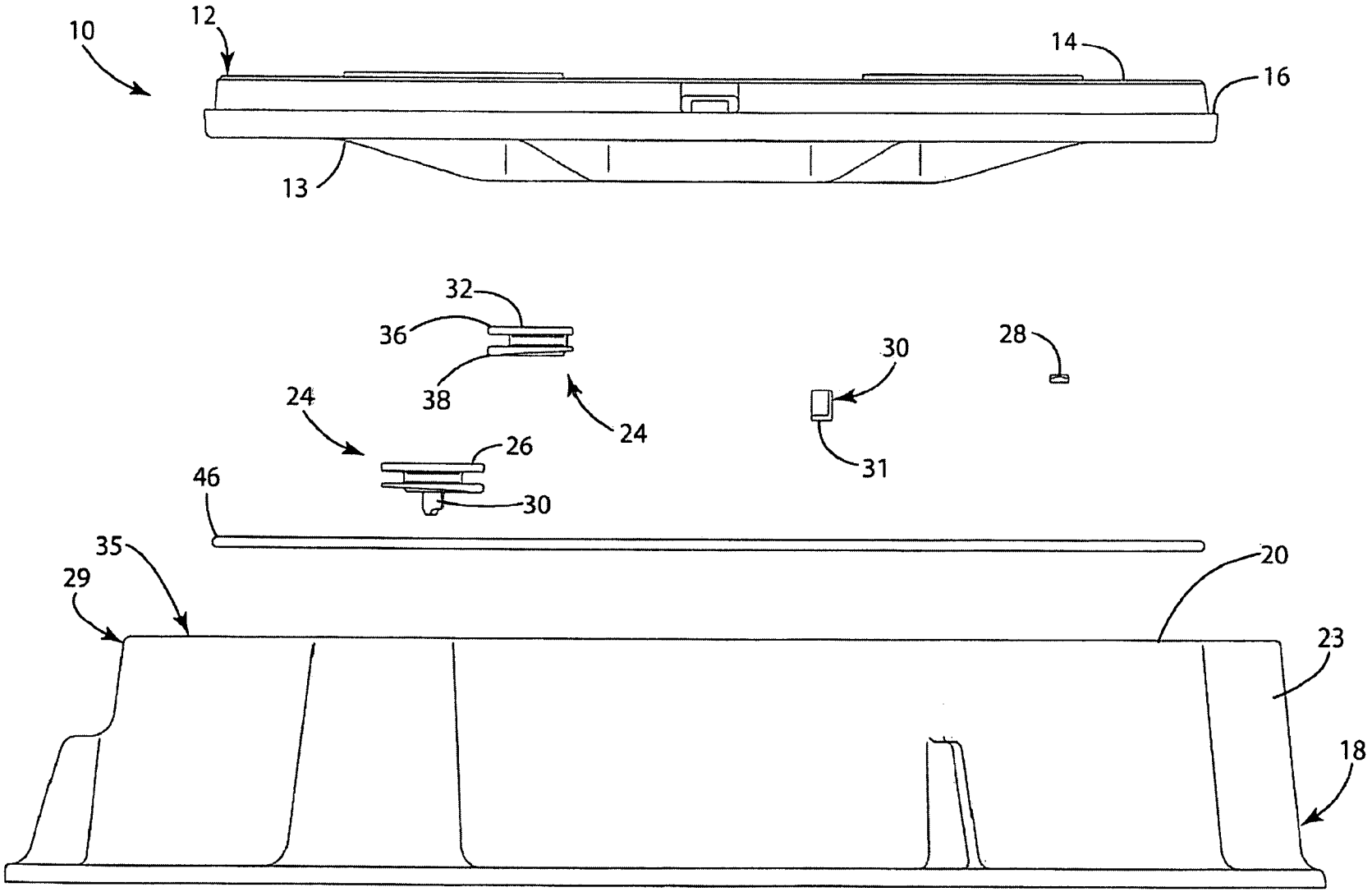
FIG. 1 is an exploded side view of the system of the present invention.
Figure 2:
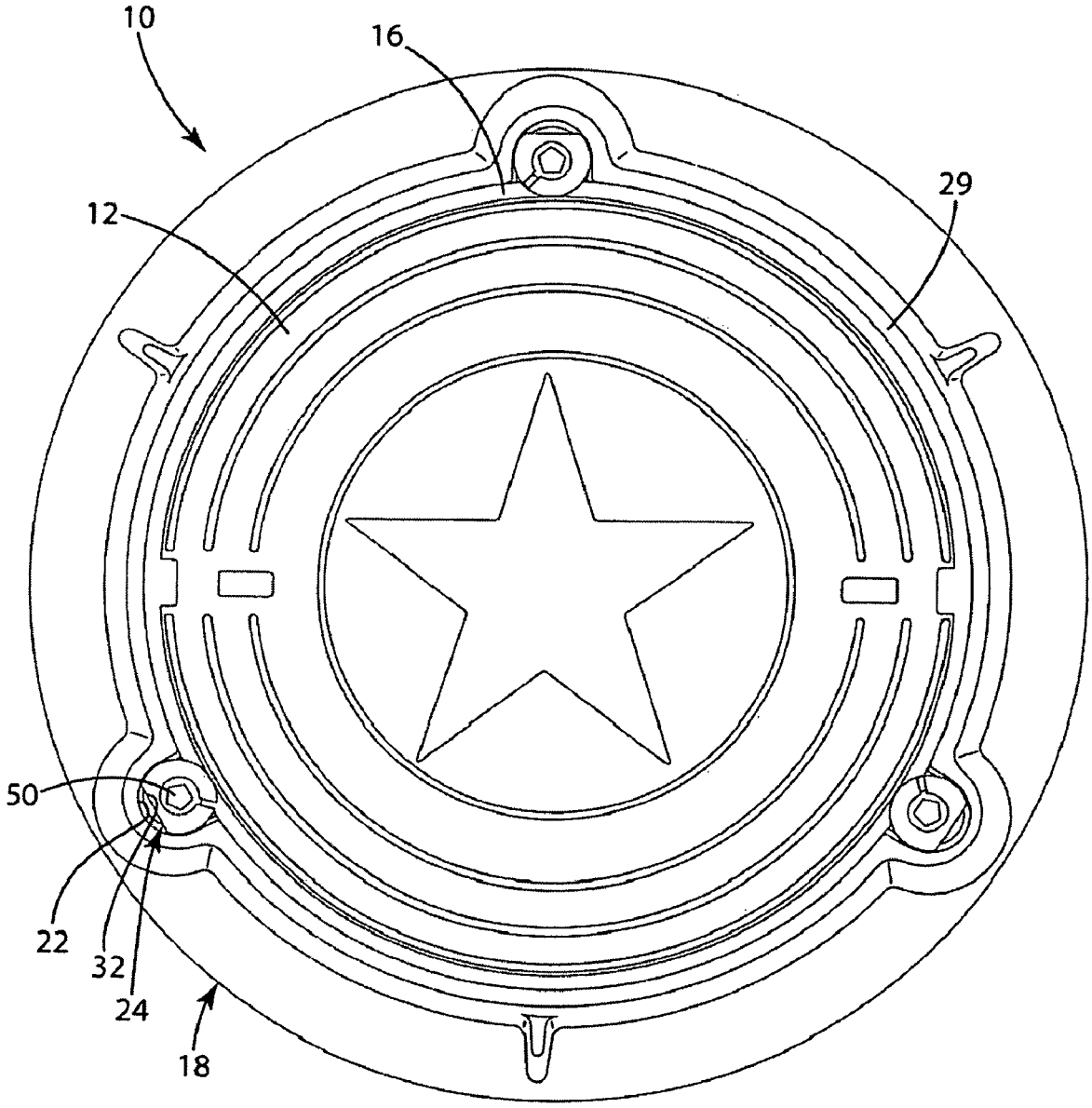
FIG. 2 is a top view of the system of the present invention in the locked or engaged position.

A manhole cover system, in accordance with an embodiment of the invention is illustrated in the drawings and generally designated 10. In the embodiment illustrated in FIGS. 1-8, the system 10 includes a cover 12, which has a lower face 13, an upper face 14, an outer circumferential edge 16, and a frame 18, which has a recess 20 into which the cover 12 can be positioned. The frame also includes at least two recesses 22 for receiving the locking devices 24. In operation, the cover 12 can be placed in the frame 18 in multiple ways and the locking devices 24 are adjusted to engage the outer circumferential edge 16 of the cover 12.

In the illustrated embodiment, the cover 12 is a generally disc-shaped ductile iron cover. Ductile iron is a cast iron that has been treated while molten with an element such as magnesium or cerium to induce the formation of free graphite as nodules or spherulites, which imparts a measurable degree of ductility to the cast metal. Ductile iron is also known as nodular cast iron, spherulitic graphite cast iron, and spheroidal graphite (SG) iron. In other embodiments the cover 12 can have other shapes and can use different materials known to those of skill in the art. Such materials include, but are not limited to, cast iron, grey iron, polymeric and composite materials. In the illustrated embodiment, the cover 12 is made of a single material; however, multiple materials can be used without departing from the spirit of the present invention. Suitable alternative materials and combinations of materials are known to those of skill in the art.

The cover 12 includes an upper face 12 that can include insignia, designs, demarcations, and/or depressions or channels for funneling excess water off of the cover 12. In one embodiment, the upper face 14 may include projections and designs that indicate the owner of the cover 10, the manufacturer, the type of infrastructure beneath the manhole or any other pattern. The lower face 12 may include a downwardly extending projection 33 extending around the cover 10 proximate the outer circumferential edge 16, such that the thickness 21 of the cover increases proximate the outer circumferential edge 16. In the illustrated embodiment, the cover 12 does not include any punctures, holes or other means by which water or other liquids can pass through the cover 12. When a watertight system is not necessary, holes and other apertures may be incorporated into the cover as desired. The lower face 13 of the cover 12 can also be machined to include a groove (not shown) or similar shape to align the gasket and assist in creating a better seal.

In the illustrated embodiment, the frame 18 is shaped to receive the cover 12. In the illustrated embodiment, the frame 18 is formed of grey iron. Grey iron is an iron-carbon alloys (and a form of cast iron) with carbon contents in excess of 2%, generally in the range 2 to 4% with the addition of about 1% silicon. Grey iron is typically different from steel because the carbon present exceeds the solubility limit of 1.7%. This carbon is present in the form of austenite while the excess exists as graphite at room temperature. Consequently, grey irons are sometimes referred to as steels with graphite in them. The structure of grey irons often display three phases, ferrite, pearlite or martensite. Grey iron may be used because of it's beneficial properties including, but not limited to, wear resistance, higher electrical resistance compared to steels, the corrosion resistance of grey irons is superior to that of carbon steel. In other embodiments, the frame 18 can have other shapes and can use different materials known to those of skill in the art. Such materials include, but are not limited to, cast iron, grey iron, polymeric and composite materials. In the illustrated embodiment, the frame 18 is made of a single material; however, multiple materials can be used without departing from the spirit of the present invention. Suitable alternative materials and combinations of materials are known to those of skill in the art.

The illustrated frame 18 is formed as a single piece. However, the frame 18 can be formed as multiple pieces that are affixed to one another. The frame 18, includes a recess or shelf 20 for receiving and maintaining the cover 12 in position. The recess 20 can also include a cover support rim 21. The frame 18 may include a frame wall 23 rising away from the substructure the frame 18 is mounted on. In the illustrated embodiment, the frame wall 23 is an annular ring defining an inner surface 25. The cover support rim 21 projects from the inner surface 25 of the frame wall 23. An upper segment 27 of the frame wall 23 may extend beyond the cover support rim 21. The upper edge 29 of the upper segment 27 may be flush with the upper surface 14 of the cover when the cover 12 is in place on the cover support rim 21. The inside diameter of the frame wall 23 is slightly greater than the diameter of the cover 12 to provide clearance between the upper segment 27 of the frame wall 23 and the outer circumferential edge 16 of the cover 12 when the cover is installed on the frame 18. In another embodiment, the lower face of the cover could rest directly on the annular top of the frame wall.

Figure 9:
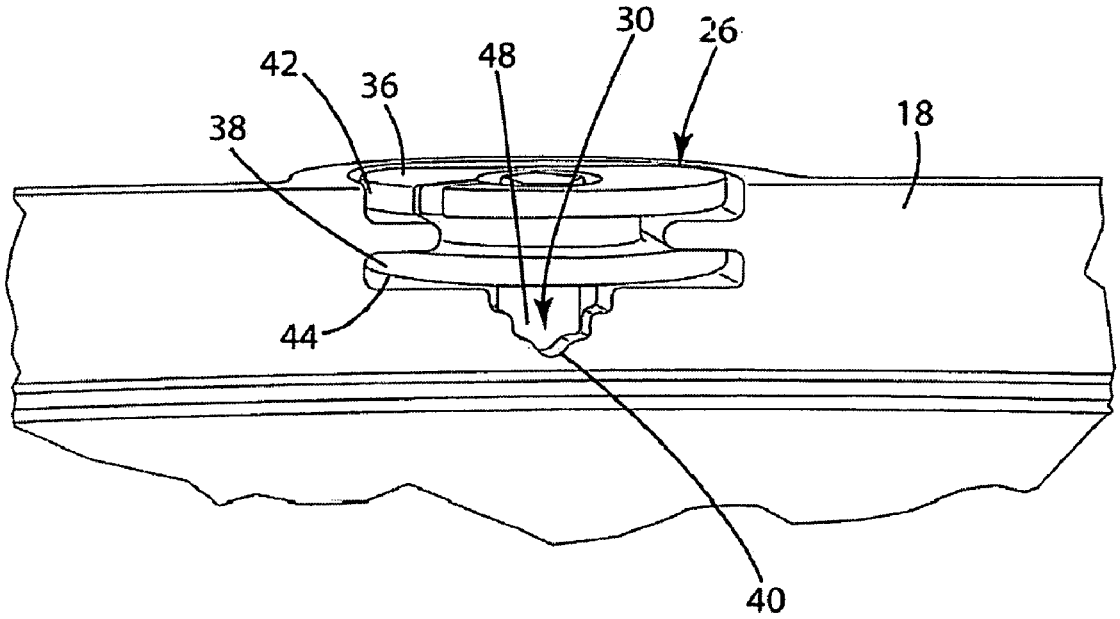
FIG. 9 is a cross-sectional side view of the locking mechanism of the present invention.
Figure 10:
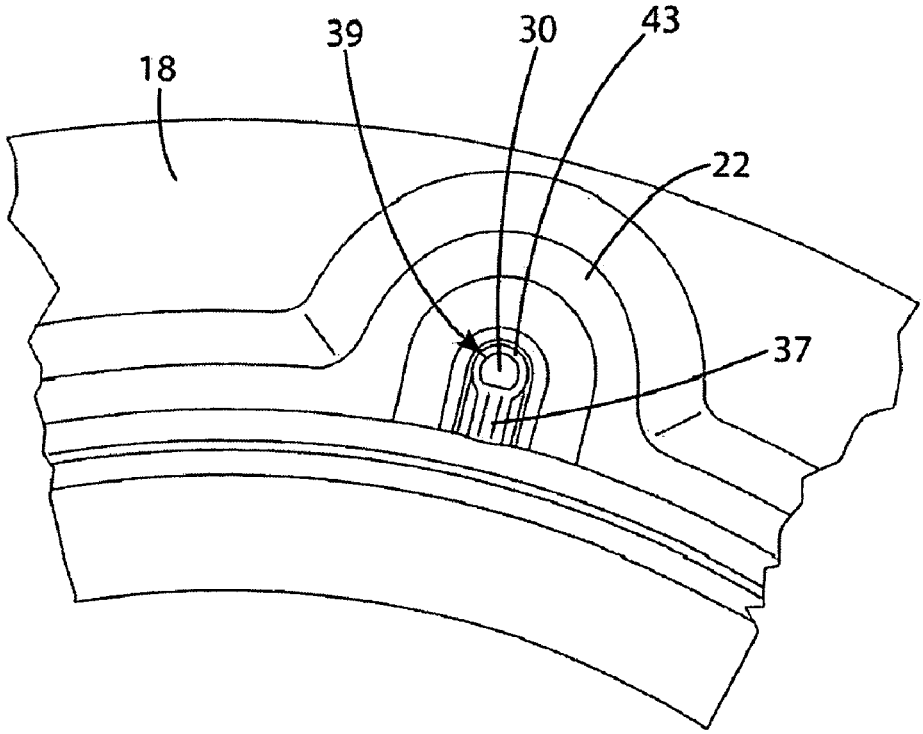
FIG. 10 is a top view of the engagement mechanism seat within the frame.
Figure 11A:
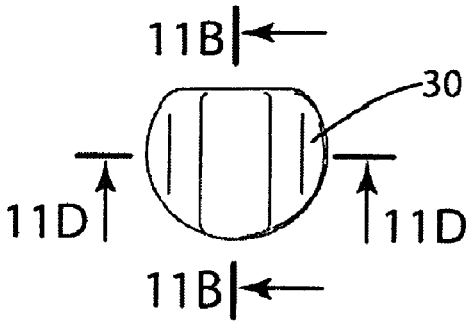
FIG. 11A is a top view of the plunger of the locking mechanism of the present invention.
Figure 11B:
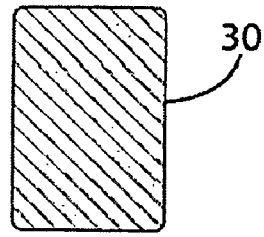
FIG. 11B is a sectional view taken along lines B-B of FIG. 11A of the plunger of the locking mechanism of the present invention.
Figure 11D:
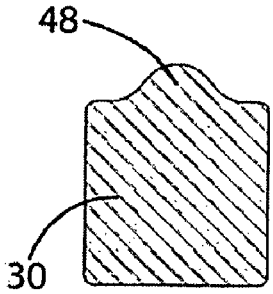
FIG. 11D is a sectional view taken along lines A-A of FIG. 11A of the plunger of the locking mechanism of the present invention.
Figure 11C:
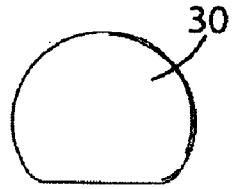
FIG. 11C is a bottom view of the plunger of the locking mechanism of the present invention.
Figure 11E:
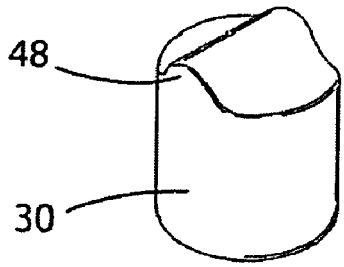
FIG. 11E is a side view of the plunger of the locking mechanism of the present invention.
Figure 12A:
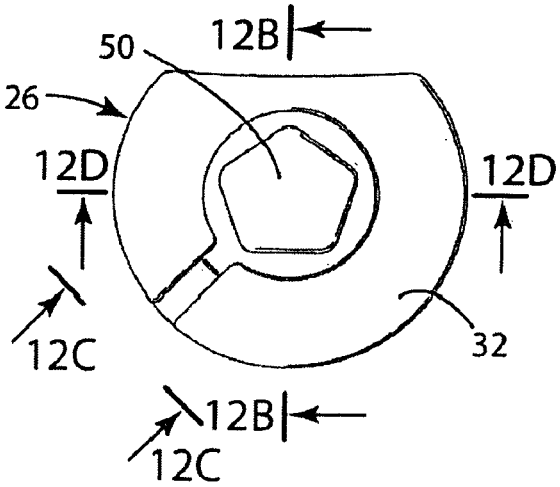
FIG. 12A is a top view of the cam lock of the locking mechanism of the present invention.
Figure 12B:
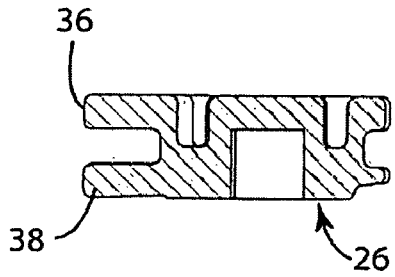
FIG. 12B is a sectional view taken along lines B-B of FIG. 12A of the cam lock of the locking mechanism of the present invention.
Figure 12C:
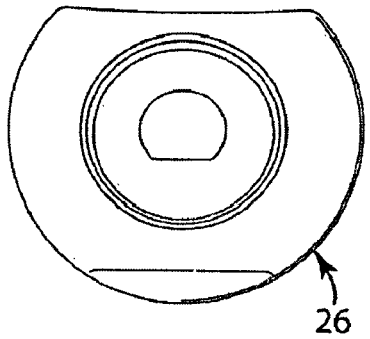
FIG. 12C is a bottom view of the cam lock of the locking mechanism of the present invention.
Figure 12D:
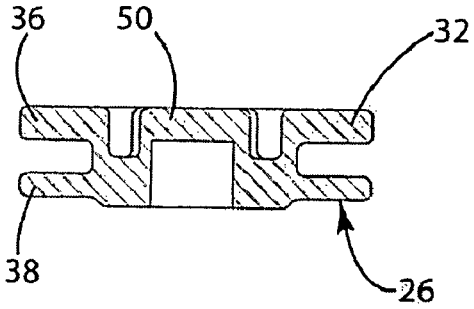
FIG. 12D is a sectional view taken along lines A-A of FIG. 12A of the cam lock of the locking mechanism of the present invention.
Figure 12E:
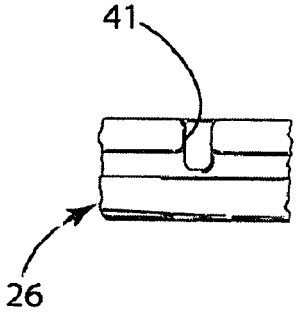
FIG. 12E is a sectional view taken along lines C-C of FIG. 12A of the cam lock of the locking mechanism of the present invention.
Figure 12F:
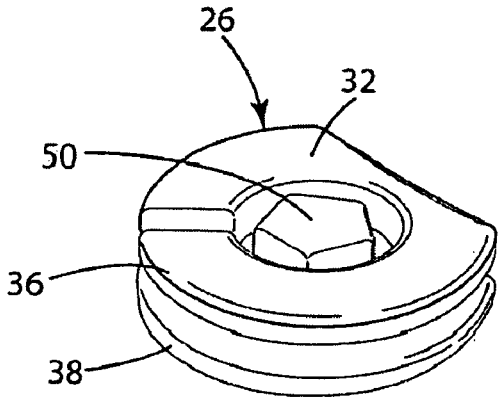
FIG. 12F is a side view of the cam lock of the locking mechanism of the present invention.

Additionally, the frame 18 includes at least one locking device seat 22. In the illustrated embodiment, the frame 18 includes three locking device seats. The locking device seats 22 are shaped to allow the locking devices 24 to be installed on the frame 18. In the illustrated embodiment, the seats 22 do not extend into the cover support rim 28. The seats 22 are disposed outside and adjacent to the manhole opening 35. The manhole opening 35 is a hole that is sized to allow a person to gain entrance to the infrastructure covered by the manhole system 10. Thus, the seats 22 do not reduce the size of or otherwise interfere with manhole opening 35. In the illustrated embodiment, the seats 22 are recessed so that they do not extend above the top surface of the frame 18. The seats 22 each include at least one alignment groove, but in the illustrated embodiment include two alignment grooves 42, 44 that engage the arms 36, 38 of the cam 26. The alignment grooves 42, 44 are slots machined or otherwise formed into the frame 18. The grooves 42, 44 may be sufficiently sized to allow easy movement of the arms 36, 38 therein. The seat 22 includes an aperture 37 that receives the plunger 30 and locks the locking mechanism 24 within the seat 22. The groove 40 of the aperture 37, as shown in FIG. 9, is shaped to accommodate an engagement mechanism 48 on a plunger 30, which is part of the locking mechanism 24. The engagement mechanism 48 can have a complex shape to ensure that once the locking mechanism 24 is engaged/locked it cannot come unlocked/unengaged unintentionally. A illustrated in FIGS. 9 and 10, the aperture 37 includes a groove 40 for receiving the plunger 30. The groove includes a trough 37 that allows the plunger 30 to enter the seat 22 and an engagement mechanism seat 39 that has a generally circular shape and prevents the engagement mechanism 48 from exiting the seat 22 when in the locked position. The engagement mechanism seat 39 extends along a diameter to interface with the engagement mechanism 48 on the bottom of the plunger 30 to bias the plunger 30 (and hence lock) in "locked" and "unlocked" positions.

Figure 3:
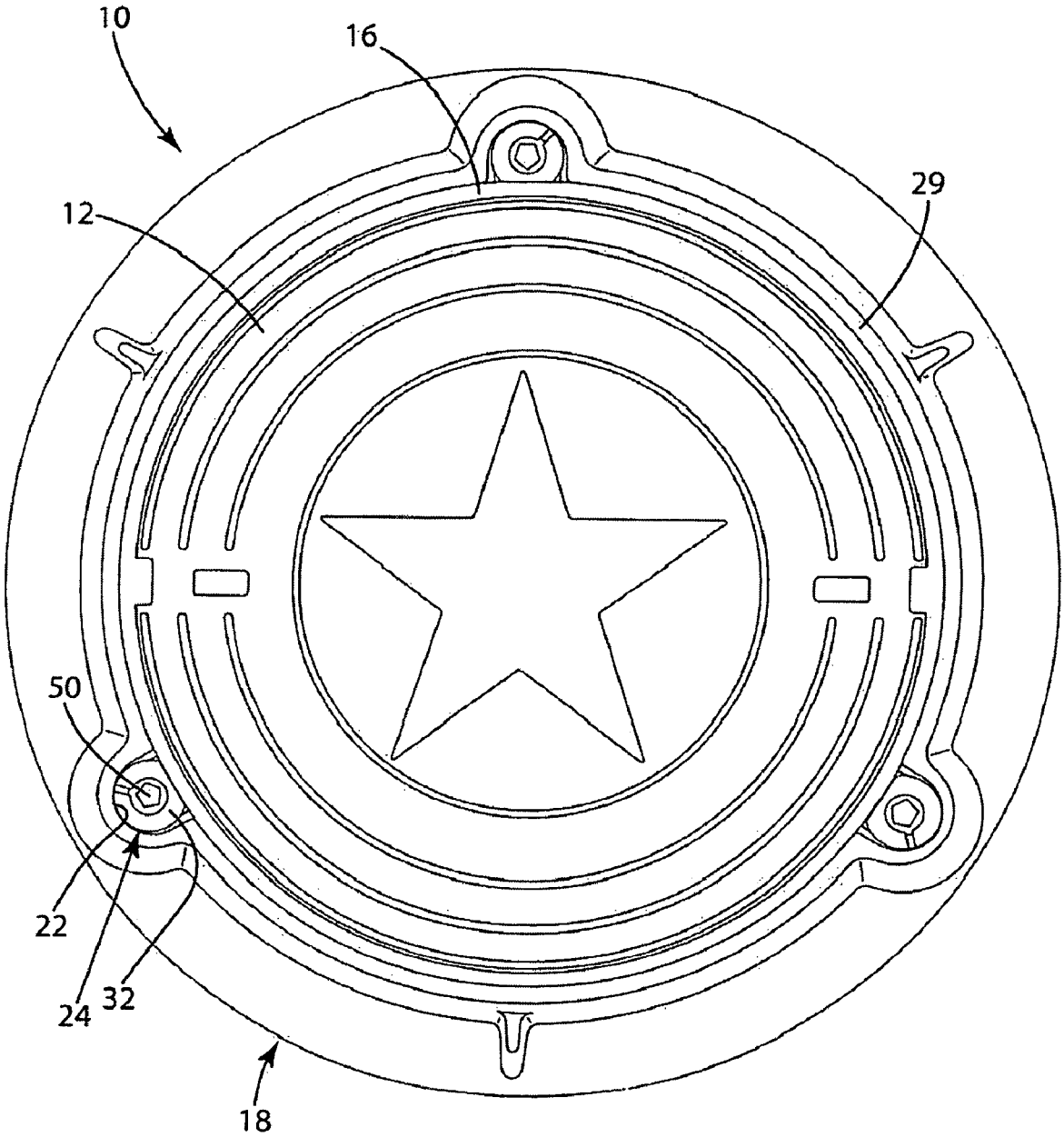
FIG. 3 is a top view of the system of the present invention in the unlocked or unengaged position
Figure 4:
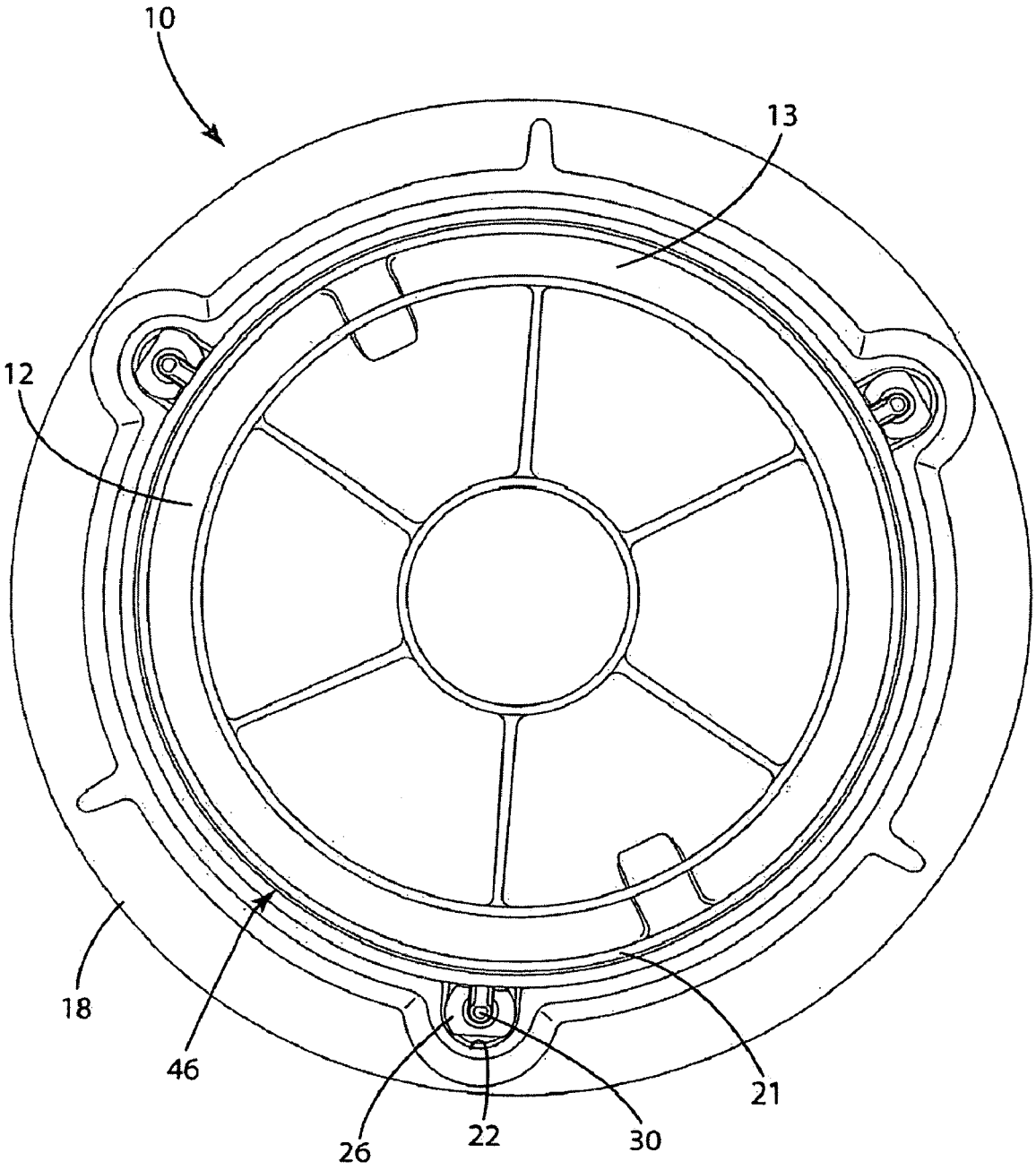
FIG. 4 is a bottom view of the system of the present invention.
Figure 5:
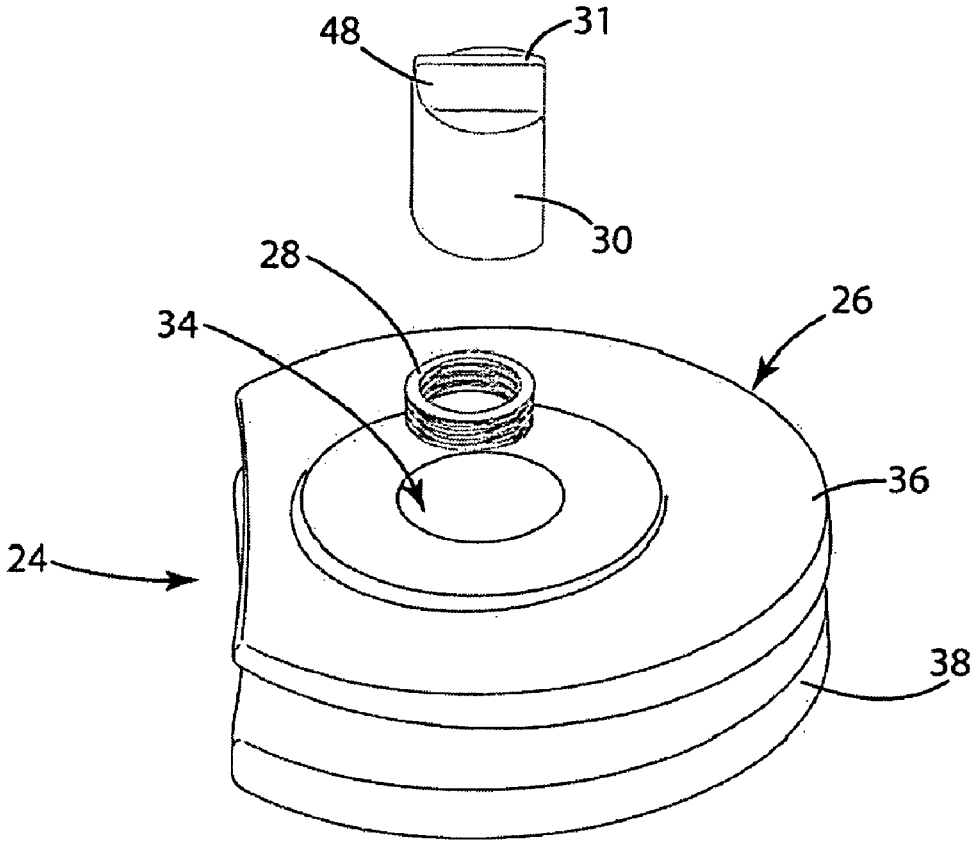
FIG. 5 is an exploded view of the locking mechanism of the present invention.
Figure 6:
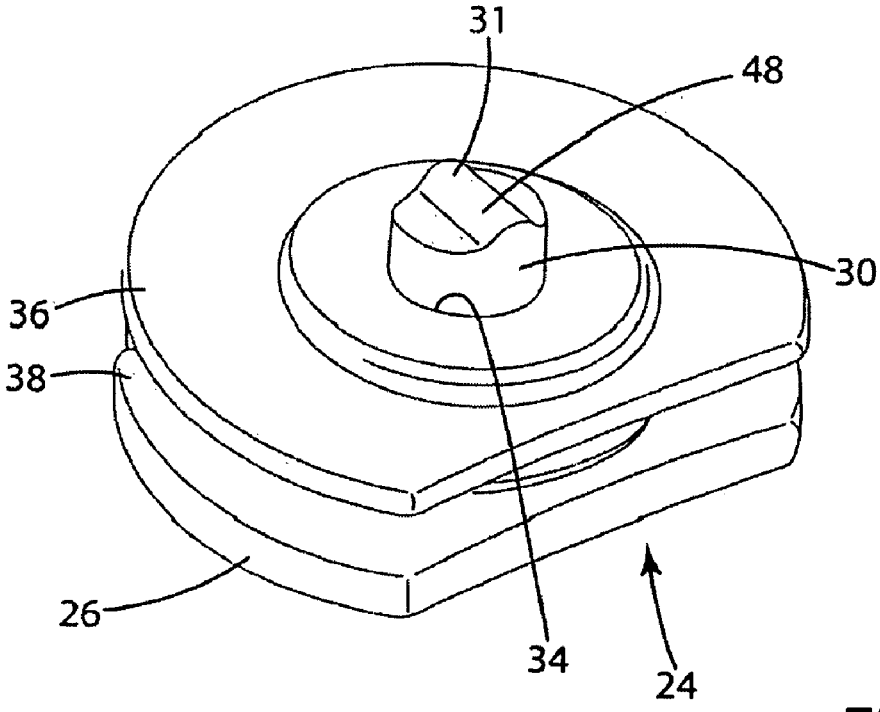
FIG. 6 is a partial side view of the locking mechanism of the present invention.
Figure 7:
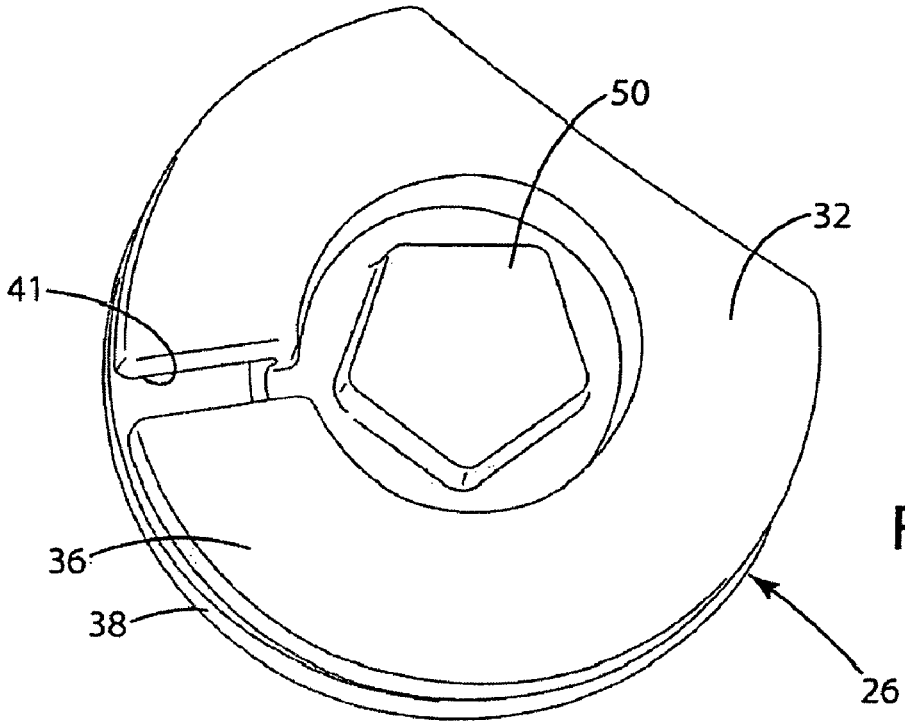
FIG. 7 is a bottom view of the locking mechanism of the present invention.
Figure 8:
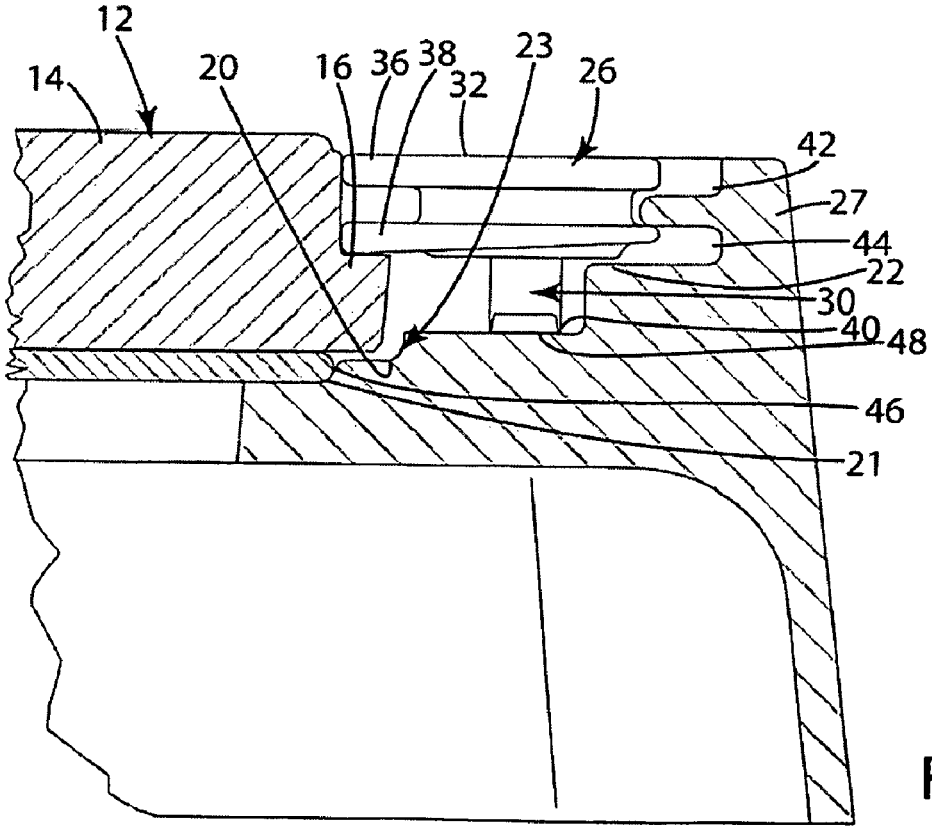
FIG. 8 is a cross-sectional side view of the locking mechanism of the present invention.

The locking device 24 of the present invention can be any device capable of both engaging the cover 12 and maintaining the cover 12 in engagement within the frame 18. The locking devices 24 interfit with the seat 22 to prevent vertical movement of locking device 24 with respect to frame 18. The locking mechanism 24 has a truncated circular shape that allows the cover 12 to be lifted and lowered in vertical direction when locks are in "unlocked" position. In the "unlocked" position, the truncated portion fully aligns with the manhole opening so that the lock does not prevent installation or removal of the cover 12 from the frame 18. The truncated edge" of the locking mechanism 24 may follow same curve as circumference of cover, such that when the locking mechanism 24 is in the unlocked position, the cover 12 is not impeded by the locking mechanism 24 during either removal or placement of the cover 12 within the frame 18, as shown in FIG. 3. The locking device 24 can also include a drainage channel 41, as shown in FIG. 7. The drainage channel 41 provides a flow path that enables fluids to be moved away from a tool engager 50 on an upper face 32 of the locking mechanism 24. The drainage channel 41 is a slot that allows water or other fluids to drain from the locking mechanism 24. The size of the drainage channel 41 can vary depending upon the use, but cannot be larger than the tool engager 50. The number of locking mechanisms 24 may vary from application to application, however, the illustrated embodiment includes three locking mechanisms 24. The locking mechanisms 24 can be positioned at regular intervals on the frame 18. For example, the illustrated embodiment includes three locking mechanisms 24 arranged in a radially symmetric pattern around the manhole opening 35.

In the illustrated embodiment, the locking device 24 includes a cam lock 26, spring 28, and plunger 30. The cam lock includes two annular, generally disc-shaped arms 36, 38 that, depending on position, can engage either alignment grooves 42, 44 of the frame 18 or the outer circumferential edge 16 of the cover 12. The lower arm 38 can be formed with an angled surface (or cammed surface) so that the arm 38 gradually and increasingly clamps the cover 12 against the frame 18 while the locking mechanism 24 is being rotated into the "locked" position. In watertight embodiments, this action gradually creates a seal between the cover 12 and frame 18. The cam lock 26 includes an upper face 32 that includes a tool engager 50 that enables a tool to engage and move the cam lock 26. The tool engager 50 may be a raised, specially shaped knob 50' (or head) that can be engaged by an appropriately shaped tool. The knob 50' can be shaped as a pentagon as shown in the figures, or in any other shape that enables a tool to both engage and move/position the cam lock 26. On the lower face 33 of the cam lock 26 there is a cylindrical bore 34 in which the spring 28 and plunger 30 will reside. The bore 34 is sized to receive the spring 28 and at least a portion of the plunger 30.

The plunger 30 may include a relatively complex shape as shown in FIG. 9. The plunger 30 engages the frame 18 via an engagement mechanism 48, which, in the illustrated embodiment, is a projection on the lower surface 31 of the plunger 30. The engagement mechanism 48 engages a groove 40 in the frame 18 such that the locking mechanism 24 is biased in either the "locked" or "unlocked" positions. In other words, the engagement mechanism 48 resist movement of the lock 26 from the "locked" or "unlocked" position and provides a biasing force that will attempt to pull the lock 26 into the "locked" or "unlocked" positions. The engagement mechanism 48 also provides tactile feedback as to whether the lock 26 is either "locked" or "unlocked." In the illustrated embodiment, the engagement mechanism 48 has a rounded bottom surface 31 to help prevent the plunger 30 (and hence the lock 26) from maintaining a partially engaged position. The upper face of the plunger engages the spring 28.

The spring 28 may be any spring capable of enabling the plunger 30 to be in a springing engagement with the frame 18. In other words, when the spring 28 is compressed by the plunger 30, this enables movement of the cam lock 26 between and engaged and unengaged conditions. When the plunger 30 is in the desired position, either engaged or unengaged, the spring 28 is allowed to expand and fill the aperture 34 in which the spring 28 is disposed. Thus, the application of pressure on the plunger 30, which is transferred to the spring 28 enables movement of the cam lock 26 into the desired condition. In the illustrated embodiment, the spring 28 is a wave spring, but other springs can also be used without departing from the spirit of the present invention. The cam lock 26, plunger 30 and spring 28 may be manufactured from various materials. However, in the illustrated embodiment, all three components are manufactured from stainless steel. The locking mechanism 24 is installed as follows. When force is applied during engagement, the plunger 30 is forced upward into the aperture 34 of the cam lock 26, compressing the spring 28. The locking mechanism 24 is then slid through the groove 40 of frame 18. The plunger 30, and specifically the engagement mechanism 48, can slide through the slot/trough 37 in an unlocked/unengaged position. When the engagement mechanism 48 enters the engagement mechanism seat 39, the locking mechanism 24 can be rotated to slowly and gradually engage the circumferential edge 16 of the cover 12. When the cam lock 26 is in the desired orientation and the plunger 30 is engaged within the groove 40, then the spring 28 is allowed to expand and create force to maintain the plunger 30 within the groove 40 until further force is applied, thus locking the cover 12 within the frame 18.

In the illustrated embodiment, the manhole cover system 10 is a watertight system that includes a gasket 46 for creating a seal between the cover 12 and frame 18. The gasket 46 can be made of rubber or any other material known to those of skill in the art. The gasket 46 assists in creating a watertight seal and is positioned between the frame 18 and the cover 12. Optionally, the cover 12 and frame 18 can include machined grooves or slots (not shown) providing additional space for the gasket 46, thereby enabling the gasket 46 to create a better watertight seal.

The metal parts described herein can be machined, sand cast investment cast or otherwise formed using suitable techniques and apparatus. Sand casting is a process in which a pattern is made in the shape of the desired part. This pattern may be made out wood, plastic or metal. Simple designs can be made in a single piece or solid pattern. More complex designs are made in multiple parts, called split patterns. A split pattern has a top or upper section, called a cope, and a bottom or lower section called a drag. Both solid and split patterns can have cores inserted to complete the final part shape. Where the cope and drag separates is called the parting line. When making a pattern it is often best to taper the edges so that the pattern can be removed without breaking the mold.

The patterns are then packed in sand with a binder, which helps to harden the sand into a semi-permanent shape. Once the sand mold is cured, the pattern is removed leaving a hollow space in the sand in the shape of the desired part. The pattern is intentionally made larger than the cast part to allow for shrinkage during cooling. Sand cores can then be inserted in the mold to create holes and improve the casting's net shape. Simple patterns are normally open on top and melted metal is poured into them. Two piece molds are clamped together and melted metal is then poured into an opening, called a gate. If necessary, vent holes can be created to allow hot gases to escape during the pour. The pouring temperature of the metal should be a few hundred degrees higher than the melting point to assure good fluidity, thereby avoiding prematurely cooling, which will cause voids and porosity. When the metal cools, the sand mold is removed and the metal part is ready for secondary operations, such as machining and plating.

Investment casting is a casting process in which an expendable pattern is surrounded by an investment compound and then baked so that the investment is hardened to form a mold and the pattern material may be melted and run off. Investment castings can be used to produce intricate and metallurgical accurate castings with very tight tolerances. This method is used to mass produce parts with near net dimensions and a high quality "as cast finish" thereby producing a visually attractive finish and reducing machining cost.

In this process an expendable pattern is made, normally by injecting wax or plastic into a metal mold. The pattern is then coated, by either pouring or dipping, with a refractory slurry (watery paste of silica and a binder) that sets at ambient temperature to produce a mold or shell. After hardening, the mold is turned upside down and the expendable pattern (wax or plastic) is melted out of the mold. To complete this refractory mold, ceramic cores may be inserted. Investment castings can be made in almost any pourable metal or alloy.

In use the system 10 functions as follows. The cover 12 is positioned within the frame 18 such that it covers the gasket 46. The locking mechanism 24 is then rotated to engage the outer circumferential edge 16 and create a watertight seal. The locking mechanism 24, when force is applied during engagement, the plunger 30 is forced upward into the aperture 34 of the cam lock 26, compressing the spring 28. When the cam lock 26 is in the desired orientation and the plunger 30 is engaged within the groove 40, then the spring 28 is allowed to expand and create force to maintain the plunger 30 within the groove 40 until further force is applied.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A manhole system comprising:

a manhole frame defining an manhole opening;

a manhole cover mounted to said frame covering said manhole opening, said manhole cover having an outer circumferential edge; and a locking mechanism mounted to said frame and selectively movable between a locked position operatively engaging said outer circumferential edge of said cover and an unlocked position operatively disengaged from said outer circumferential edge of said cover, said locking mechanism securing said cover on said frame when in said locked position, said locking mechanism permitting removal of said cover from said frame when in said unlocked positions; said locking mechanism comprising:

a cam lock including an angled surface that gradually engages said outer circumferential edge, said cam lock being rotatable about an axis perpendicular to said cover, thereby increasingly clamping said cover onto said frame;

a plunger for maintaining the position of said cam lock; and a spring for activating said plunger;

wherein said frame further includes locking mechanism seats for receiving said locking mechanism, said locking mechanism seats being recessed within said frame; and wherein said outer circumferential edge has recessed annular flanges for receiving said locking mechanisms.

2. The system of claim 1, wherein said annular flanges extend about said circumferential edge such that said locking mechanism can engage any position about said circumferential edge.

3. A manhole system comprising:

a manhole cover having an outer circumferential edge;

a cam lock mounted to said frame and selectively movable between a locked position operatively engaging said outer circumferential edge of said cover and an unlocked position operatively disengaged from said outer circumferential edge of said cover, said cam lock securing said cover on said frame when in said locked position, said cam lock permitting removal of said cover from said frame when in said unlocked positions, wherein said cam lock further comprises a plunger for maintaining the position of said cam lock and a spring for activating said plunger, said cam lock including an angled surface that gradually engages said outer circumferential edge, said cam lock being rotatable about an axis perpendicular to said cover, thereby increasingly clamping said cover onto said frame; and a manhole frame sized to support said manhole cover thereon, said frame including a cam lock seat for engaging and maintaining said cam lock in place within said frame, said cam lock seat being recessed within said frame; and wherein said outer circumferential edge has recessed annular flanges for receiving said cam lock.

4. The system of claim 3, wherein said annular flanges extend about said circumferential edge such that said cam lock can engage at any position about said circumferential edge.

* * * * *